US005287838A

United States Patent [19]

Wells

[11] Patent Number: 5,287,838

[45] Date of Patent: Feb. 22, 1994

[54] COMPACT REVERSE FLOW CHECK VALVE ASSEMBLY FOR A UNIT FLUID PUMP-INJECTOR

[75] Inventor: Glenn C. Wells, Minonk, Ill.

[73] Assignee: Caterpillar Inc., Peoria, Ill.

[21] Appl. No.: 23,225

[22] Filed: Feb. 26, 1993

[51] Int. Cl.[5] ..... F02M 37/04

[52] U.S. Cl. ..... 123/467; 123/506

[58] Field of Search ..... 123/467, 506, 446; 239/88-96

[56] References Cited

U.S. PATENT DOCUMENTS

| | | | |
|---|---|---|---|
| 4,246,876 | 1/1981 | Bouwkamp | 123/467 |
| 4,392,612 | 7/1983 | Deckard et al. | 239/88 |
| 4,437,443 | 3/1984 | Hofbauer | 123/467 |
| 4,478,189 | 10/1984 | Fenne | 123/467 |
| 4,527,738 | 7/1985 | Martin | 239/90 |
| 4,627,571 | 12/1986 | Kato | 123/467 |
| 4,684,067 | 8/1987 | Cotter | 123/467 |
| 4,798,168 | 1/1989 | Ganser | 123/467 |
| 4,831,989 | 5/1989 | Haines | 123/506 |
| 5,121,730 | 6/1992 | Ausman et al. | 123/467 |
| 5,219,122 | 6/1993 | Iwanaga | 123/446 |

FOREIGN PATENT DOCUMENTS

| | | | |
|---|---|---|---|
| 0061534 | 10/1982 | European Pat. Off. | 123/467 |
| 0249664 | 12/1985 | Japan | 123/467 |
| 789234 | 1/1958 | United Kingdom | 123/467 |

*Primary Examiner*—Carl S. Miller

*Attorney, Agent, or Firm*—Anthony N. Woloch

[57] ABSTRACT

An improved reverse flow check valve assembly adapted for a unit fluid pump-injector including a first stop having at least one inlet passage, a second stop, and a movable check. The check includes an internal passage spaced from the inlet passage defined in the first stop.

The present embodiment has a configuration which is compact and minimizes wear without compromising performance.

7 Claims, 3 Drawing Sheets

COMPACT REVERSE FLOW CHECK VALVE ASSEMBLY FOR A UNIT FLUID PUMP-INJECTOR

DESCRIPTION

1. Technical Field

The present invention relates generally to unit fluid pump-injectors and, more particularly to reverse flow check valve assemblies for such pump-injectors.

2. Background Art

Known reverse flow check valve assemblies for unit fuel pump-injectors are shown in FIG. 2 of U.S Pat. No. 4,527,738 issued to Martin on Jul. 9, 1985 and in FIG. 1 of U.S. Pat. No. 4,392,612 issued to Deckard et al. on Jul. 12, 1983. The function of such check valve assemblies is to permit communication of high pressure fuel from a pump chamber to an injection nozzle of the injector during an injection phase and to prevent communication (i.e, reverse flow) of engine cylinder combustion gas from the injection nozzle to the pump chamber during a non-injection phase if the injection nozzle becomes leaky.

The above check valve assemblies each include a movable one-way flow check in the form of an imperforate plate which, during the injection phase, provides only one flow path past the check. This flow path is defined by an annular clearance between the outer periphery of the check and a wall of a bore in which the check is positioned. The above annular clearance must be relatively loose in order to provide a flow cross-sectional area which permits a sufficient amount of injection fuel flow as required by a particular injector. One problem which may occur with the relatively loose annular clearance is that the movable check may become cocked or tilted in its bore. Undesirable wear results as the cocked check moves back and forth between upper and lower seats.

Another problem with the above check valve assemblies is that they may not fit in some unit fuel pump-injectors if only very limited space is available. For example, FIG. 5 of U.S. Pat. No. 5,121,730 issued to Ausman et al. on Jun. 16, 1992 shows that the available space for a reverse flow check assembly may be limited and offset with respect to the pump chamber axis due to the location and proximity of a fuel inlet check leading to the pump chamber. In order to provide a reverse flow check valve assembly for the pump-injector of Ausman et al. using a reverse flow check valve assembly similar to those shown in Martin or Deckard et al., the displacement or lift of the check may have to be increased to provide sufficient fuel flow. Such increase in lift may prevent such reverse flow check valve assembly from fitting within the limited space available.

The present invention is directed to overcoming one or more of the problems as set forth above.

DISCLOSURE OF THE INVENTION

In one aspect of the present invention a reverse flow check valve assembly is disclosed comprising a first stop, a second stop, and a check. The first stop has a seat and at least one inlet passage. The second stop has another seat and at least one outlet passage. The check is movable between the two seats and has internal passage means for communicating fluid from the inlet passage to the outlet passage when the check is seated on the second seat. Moreover, the internal passage means of the check is spaced from the inlet passage of the first stop.

The present embodiment provides an improved reverse flow check valve assembly having a configuration which is compact and minimizes wear while maintaining performance.

BEST MODE FOR CARRYING OUT THE INVENTION

Figure 1:
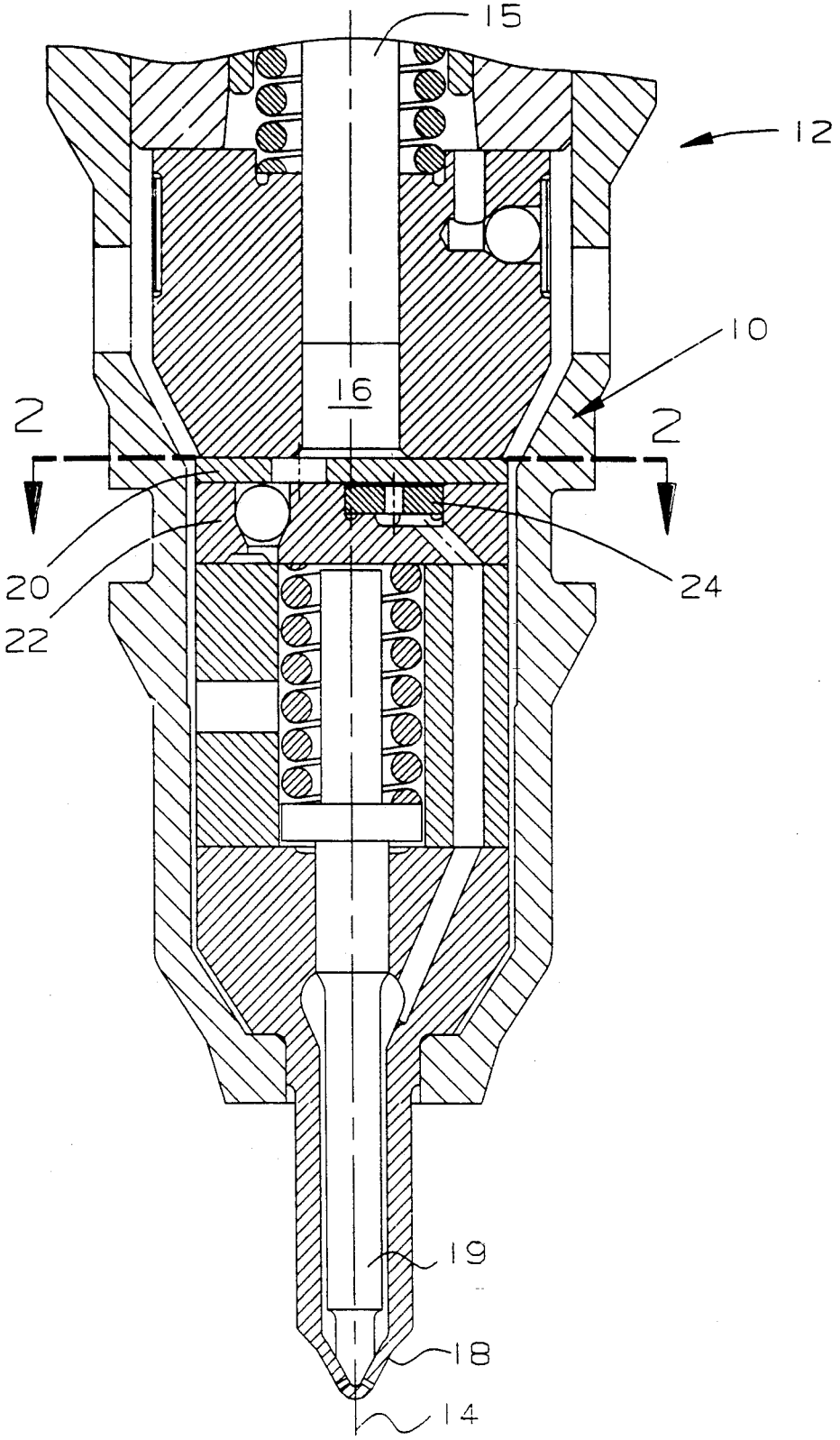
FIG. 1 is a diagrammatic partial cross-sectional view of one embodiment of the present invention as installed in an exemplary unit fluid pump-injector.

Referring to FIGS. 1–4, wherein similar reference characters designate similar elements or features throughout these figures, there is shown an embodiment of a reverse fluid flow check valve assembly 10 adapted for an exemplary unit fuel pump-injector 12. As shown in FIG. 1, the unit pump-injector includes a main or central longitudinal axis 14, a reciprocal pump plunger 15, a high pressure fuel pump chamber 16, and an injection nozzle 18 having a reciprocal needle check 19 and one or more injection orifices.

Figure 2:
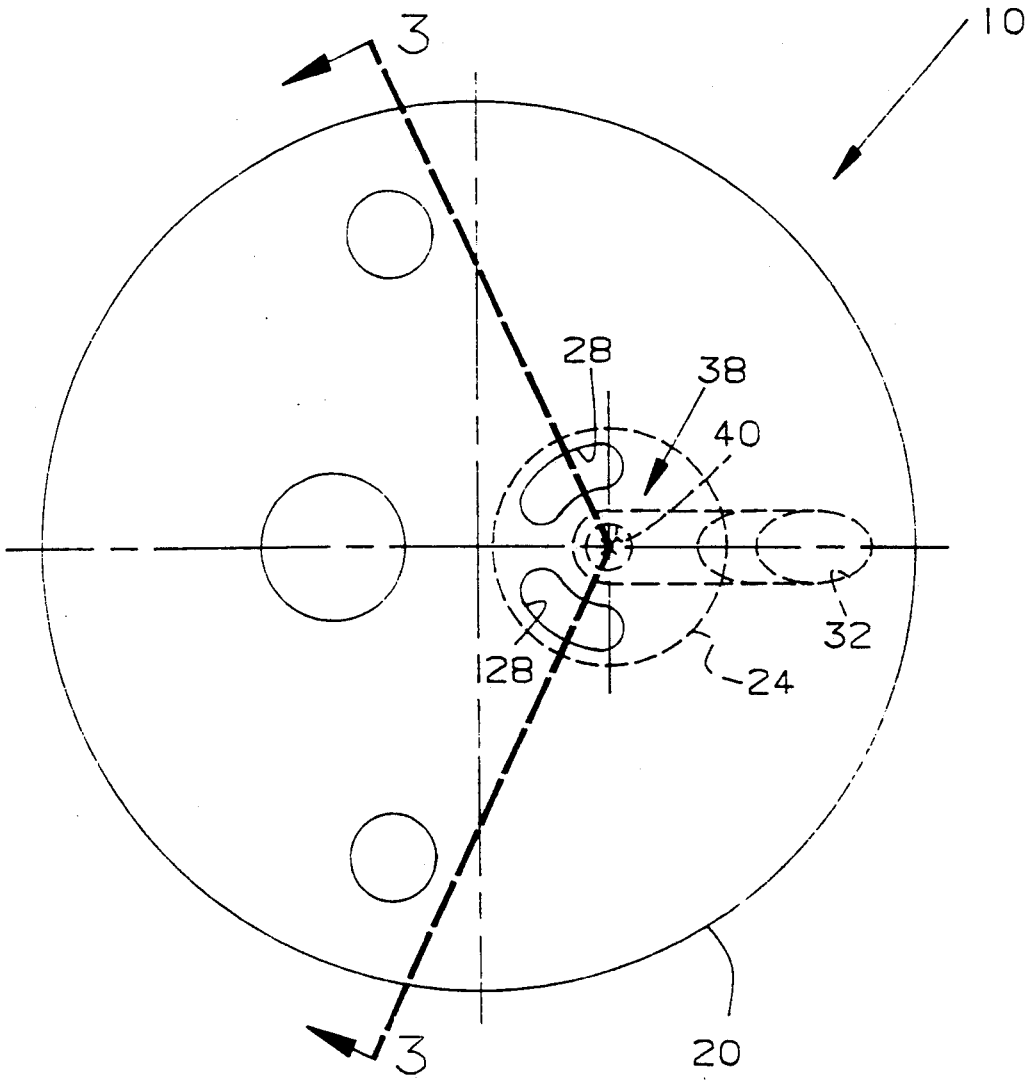
FIG. 2 is a diagrammatic enlarged partial plan view of the reverse flow check valve assembly taken along line 2—2 of FIG. 1.
Figure 3:
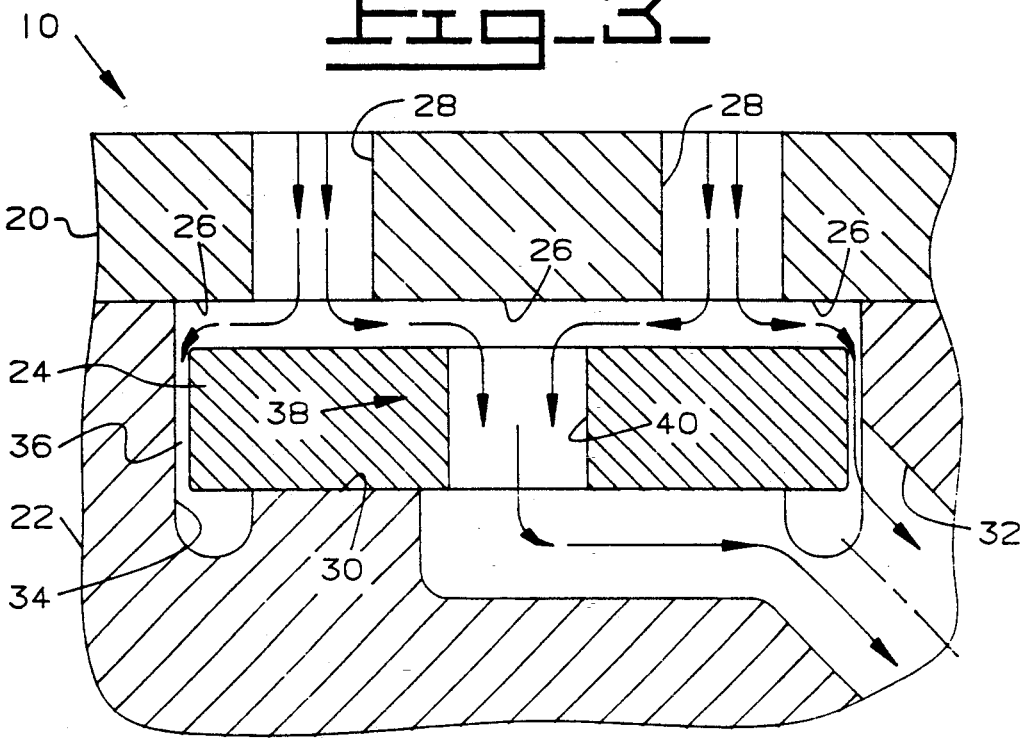
FIG. 3 is diagrammatic enlarged partial view taken generally along line 3—3 of FIG. 2 but showing an angled portion of an outlet passage in the second stop rotated so that it appears in this view. In this view, the check is seated on the second or lower stop.
Figure 4:
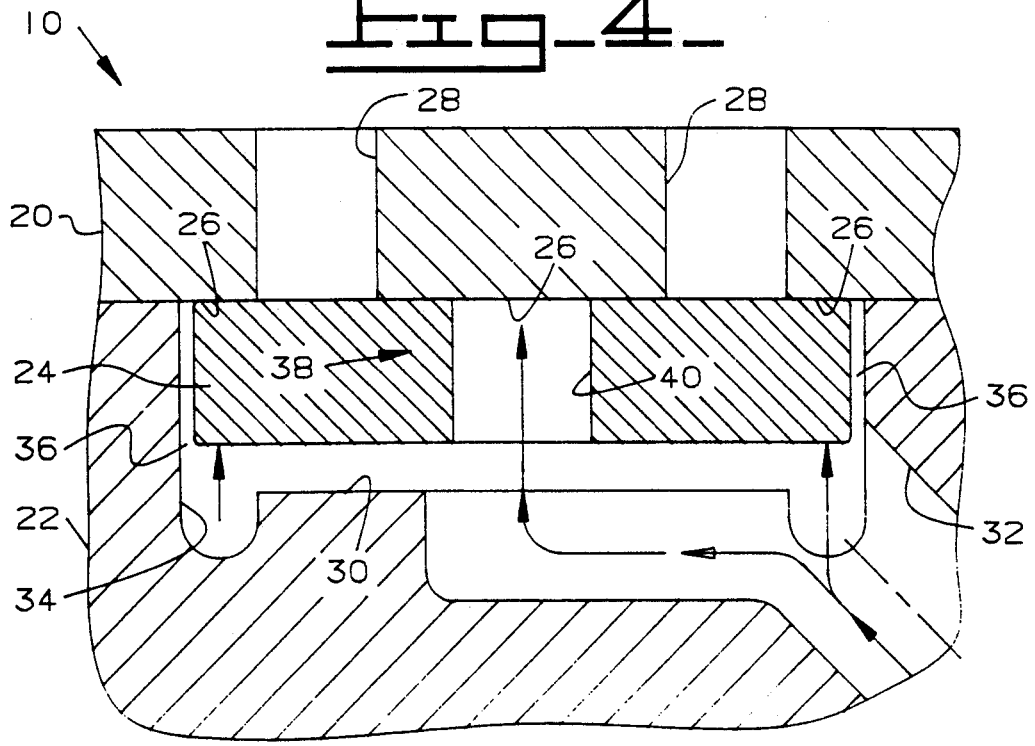
FIG. 4 is a diagrammatic view similar to FIG. 3 but showing the check seated on the first or upper stop.

The reverse check valve assembly 10 includes an upper or first stop 20, a lower or second stop 22, and a one-way flow check 24. The first stop 20 is preferably in the form of a flat plate that includes a first planar seat 26 and at least one inlet passage 28 which is adapted to be in continuous fluid communication with the pump chamber 16. Preferably, as shown in FIGS. 2–4, there are a pair of spaced apart inlet passages 28 which have a kidney-shaped or crescent-shaped cross-sectional area as shown in FIG. 2.

The second stop 22 has a second seat 30 and at least one outlet passage 32 which is adapted to be in continuous fluid communication with the injection nozzle 18. Preferably, the second seat 30 has a horseshoe-shaped planar surface facing the check 24. Either the first stop 20 or the second stop 22 defines a bore 34. In the embodiment shown, the second stop 22 defines the bore 34 at a location so that the bore axis is offset or radially outwardly spaced from the main longitudinal axis 14 of the unit pump-injector 12.

Preferably, the check 24 is in the form of a flat circular plate. The check 24 is positioned in the bore 34 according to a selected annular clearance 36 and is movable between the first and second seats 26,30. The size of the annular clearance 36 is selected with various considerations or trade-offs in mind. The size is preferably small enough to ensure that the check 24 does not cock or laterally shift to the extent that the check would not always positively seal against the first seat 26 when reverse fluid flow occurs from the injection nozzle 18 to the pump chamber 16. The size is also selected, with manufacturing tolerances of the assembly 10 in mind, to be large enough so that the annular clearance 36 always permits the check 24 to move freely between the seats 26,30 along the direction of the axis 14. Moreover, if the available space for the assembly 10 is so limited, the size may also be selected large enough to communicate a portion of the required fluid flow past the check 24 during an injection phase. The annular clearance 36 is adapted to communicate fluid, such as fuel, from the inlet passages 28 of the first stop 20 to the outlet passage 32 of the second stop 22 when the check 24 is seated on the second seat 30.

The check 24 has an internal passage means 38 for communicating fluid in parallel relationship with the annular clearance 36 from the inlet passages 28 to the outlet passage 32 when the check 24 is seated on the second seat 30. Preferably, the internal passage means 38 is a cylindrical passage 40 defined through the center of the check 24. The check 24 is adapted to positively block communication of fluid from the outlet passage 32 to the inlet passages 28 when the check 24 is seated on the first seat 26. As shown in FIGS. 2-3, the internal passage means 38 of the check 24 is preferably radially inwardly spaced from the inlet passages 28 of the first stop 20 and arranged so that the flow of fluid from the outlet passage 32 to the inlet passages 28 is blocked when the check 24 is seated on the first seat 26. Preferably, the second seat 30 at least partially or substantially surrounds the internal passage means 38 of the check 24 and is radially outwardly spaced therefrom. As shown in FIGS. 2-3, the outlet passage 32 preferably intersects the second seat 30 to define a radial slot portion which directly and continuously communicates with the internal passage means 38 of the check 24. Referring to FIG. 3, the passage 32 of the second stop 22 preferably includes an annular groove surrounding or encompassing the second seat 30. This annular groove is arranged in direct and continuous fluid communication with the annular clearance 36.

INDUSTRIAL APPLICABILITY

The improved reverse flow check valve assembly 10 of the present invention provides a compact design which minimizes wear while maintaining performance.

FIG. 3 illustrates operation of the check valve assembly 10 during an injection phase of the unit fluid pump-injector 12. High pressure fluid, such as fuel, flows from the pump chamber 16 and through the inlet passages 28 of the first stop. The fluid hydraulically displaces the check 24 so that the check 24 seats against the second seat 30. The fluid exiting the inlet passage 28 divides into two parallel flow paths. The first flow path is defined by the annular clearance 36 between the outer radial periphery of the check 24 and the wall defining bore 34. The second flow path is through the internal passage 40. The above two flow paths then communicate with the outlet passage 32 of the second stop 22.

After the injection phase ends, reverse fluid flow from the injection nozzle 18 hydraulically displaces the check 24 upwardly so that it seats against the first seat 26 of the first stop 20. This position of the check 24 blocks fluid communication from the injection nozzle 18 to the pump chamber 16 and thereby prevents the ingestion of engine cylinder combustion gas into the pump chamber 16.

The internal passage means 38 of the check 24 allows the annular clearance 36 between the check 24 and the bore 34 to be relatively smaller than that found in the above-described reverse flow check valve assemblies. The relatively small clearance helps prevent cocking, excessive lateral shifting and wear of the check 24 as the check 24 moves between the first and second seats 26,30. Thus, a positive seal is maintained when the check 24 seats on the first seat 26. The annular second seat 30 provides a relatively large contact area for minimizing wear between the check 24 and the second seat 30.

The preferred kidney shape of the passages 28 provides a compact configuration for the check valve assembly 10 without compromising performance. Such performance is measured by the check's ability to communicate sufficient fuel flow during an injection phase. As shown by FIG. 3, the perimeter length of each passage 28 and the check lift help determine the allowable fluid flow past the check 24. The above parameters define an annular flow area below each of the passages 28 wherein each flow area is bounded by the first seat 26 of the first stop 20, the upper seating surface of the check 24, and the perimeter length of the respective passage 28 projected between the seat 26 and the check 24. Maximizing the perimeter length of those passages 28 allows the maximum lift or displacement of the check 24 to be reduced and thereby provide a more compact configuration with respect to the longitudinal axis 14 of the unit pump-injector.

Other aspects, objects, and advantages of this invention can be obtained from a study of the drawings, the disclosure, and the appended claims.

I claim:

1. A reverse flow check valve assembly adapted for a unit fuel pump-injector having a pump chamber and an injection nozzle, said check valve assembly comprising:

a first stop having a first seat and at least one inlet passage adapted to be in fluid communication with the pump chamber;

a second stop having a second seat and at least one outlet passage adapted to be in fluid communication with the injection nozzle, one of the first and second stops defining a bore; and a check positioned in the bore according to a selected annular clearance and movable between the first and second seats, said annular clearance defining a first flow path adapted to communicate fluid from the inlet passage to the outlet passage when the check is seated on the second seat, said check having internal passage means for communicating fluid in parallel with the first flow path from the inlet passage to the outlet passage when the check is seated on the second seat, said check arranged to block communication of fluid from the outlet passage to the inlet passage when the check is seated on the first seat.

2. The reverse flow check valve assembly of claim 1 wherein said internal passage means of the check is spaced from the inlet passage of the first stop so that flow of fluid from the outlet passage to the inlet passage is blocked when the check is seated on the first seat.

3. The reverse flow check valve assembly of claim 2 wherein said inlet passage of the first stop has a kidney-shaped cross-sectional area.

4. The reverse flow check valve assembly of claim 2 wherein said inlet passage of the first stop has a crescent-shaped cross-sectional area.

5. The reverse flow check valve assembly of claim 1 wherein said second seat of the second stop at least partially surrounds the internal passage means of the check and is radially outwardly spaced from the internal passage means.

6. The reverse flow check valve assembly of claim 1 wherein said check is a flat plate and said internal passage means is a passage centrally defined through the check.

7. A reverse fluid flow check valve assembly adapted for a unit fuel pump-injector having a central longitudinal axis, a pump chamber and an injection nozzle, said check valve assembly comprising:

a first stop having a first seat and at least one inlet passage adapted to be in continuous fluid communication with the pump chamber;

a second stop having a second seat and at least one outlet passage adapted to be in continuous fluid communication with the injection nozzle, one of the first and second stops defining a bore having an axis radially spaced from the longitudinal axis of the pump-injector; and a one-way flow check positioned in the bore according to a selected annular clearance and movable between the first and second seats, said annular clearance providing a first flow path adapted to communicate fuel from the inlet passage to the outlet passage when the check is seated on the second seat, said check having internal passage means for communicating fluid in hydraulically parallel relationship with the first flow path from the inlet passage to the outlet passage when the check is seated on the second seat, said internal passage means of the check being radially inwardly spaced from the inlet passage of the first stop and arranged so that the flow of fluid from the outlet passage to the inlet passage is positively blocked when the check is seated on the first seat, said second seat at least partially surrounding the internal passage means and being radially outwardly spaced therefrom.

* * * * *